US006440002B1

(12) United States Patent
Jackson

(10) Patent No.: US 6,440,002 B1
(45) Date of Patent: Aug. 27, 2002

(54) TOP LOADING SWING TYPE AMUSEMENT RIDE

(75) Inventor: William L. Jackson, Longmont, CO (US)

(73) Assignee: Skycoaster, Inc., Longmont, CO (US)

( * ) Notice: Subject to any disclaimer, the term of this patent is extended or adjusted under 35 U.S.C. 154(b) by 0 days.

(21) Appl. No.: 09/709,014

(22) Filed: Nov. 15, 2000

(51) Int. Cl.[7] ..... A63G 9/00
(52) U.S. Cl. ..... 472/118; 472/125
(58) Field of Search ..... 472/45, 46, 47, 472/49, 50, 118, 136, 137, 125, 119

(56) References Cited

U.S. PATENT DOCUMENTS

| | | | | |
|---|---|---|---|---|
| 1,220,332 A | | 3/1917 | Happel | |
| 5,094,448 A | * | 3/1992 | Hackett | 472/136 |
| 5,267,906 A | | 12/1993 | Kitchen et al. | |
| 5,527,223 A | | 6/1996 | Kitchen et al. | |
| 5,573,465 A | | 11/1996 | Kitchen et al. | |
| 5,649,866 A | * | 7/1997 | Balwanz | 472/118 |
| 5,803,815 A | | 9/1998 | Kitchen | D21/242 |
| 5,827,124 A | | 10/1998 | Kleimeyer et al. | |
| D400,615 S | | 11/1998 | Kitchen | |
| 5,931,740 A | | 8/1999 | Kitchen | |
| 5,989,127 A | | 11/1999 | Kitchen et al. | |

FOREIGN PATENT DOCUMENTS

| | | | |
|---|---|---|---|
| AU | A-75360/96 | 6/1997 | A63G/9/00 |
| AU | A-65963/98 | 11/1998 | A63G/9/00 |
| AU | A-65964/98 | 11/1998 | A63G/9/00 |
| AU | A-65965/98 | 11/1998 | A63G/9/16 |
| FR | 695488 | 12/1930 | |

* cited by examiner

*Primary Examiner*—Kien T. Nguyen
(74) *Attorney, Agent, or Firm*—Rick Martin; Patent Law Offices of Rick Martin, P.C.

(57) ABSTRACT

A giant swing ride features a launch tower rider loading platform that surrounds the rider with a safety rail and/or wall to prevent falling from the rider loading platform during loading. Various launch mechanisms include a release hook, a falling door and a retracting floor.

18 Claims, 8 Drawing Sheets

TOP LOADING SWING TYPE AMUSEMENT RIDE

FIELD OF INVENTION

This present invention relates to a swing-type amusement ride which has a loading tower for loading the riders high in the air, the loading tower having a 360° safety guardrail and wall to prevent falling, wherein disembarkment is done at the ground surface.

BACKGROUND OF THE INVENTION

Heretofore, there have been a variety of different types of amusement rides and apparatus for simulating the reduction of gravity to a rider. Some of these devices are known to be disclosed in Fitch, U.S. Pat. No. 857,338; Ridgway, U.S. Pat. No. 2,779,596; Ryan, U.S. Pat. No. 3,701,528; Greenwood, U.S. Pat. No. 4,978,120; Kitchen et al., U.S. Pat. No. 5,267,906; Kitchen et al., U.S. Pat. No. 5,527,223; and Kitchen, U.S. Pat. No. 5,931,740 (1999).

Furthermore, there have been a variety of playground and backyard swings and swing sets used by children and adults. These swings can vary in height from a small swing standing about three meters high, to a large swing standing about five meters high. A rider of such a swing normally takes a sitting position in a swing seat and starts its pendulum motion from a position in which the swing is vertical, unless aided by a running start, or by a person to help push and enhance the height of the swing arc. While the sitting or standing position on a swing seat is the norm, riders have been known to lie on their stomachs on top of a swing seat and swing in a prone position, but without being secured to the swing.

Even the most skillful and powerful swing rider on a large swing will rarely exceed a 2 o'clock or 10 o'clock position at a height of about seven meters, before gravity overtakes the centrifugal force of the swing, and slack occurs in the swing rope or chain. Should a rider manage to force the swing to make a 360 degree circuit, his or her height would seldom exceed about ten meters from the ground.

The use of external equipment to assist a swing rider to begin his or her ride from an elevated position is taught in Hoppes U.S. Pat. No. 1,731,532; Pruessner U.S. Pat. No. 1,918,559; and Walker U.S. Pat. No. 3,140,870. Each of these references discloses standard playground and backyard type swing systems which have adjacent stairs a person climbs to start swinging from a position above the ground. The rider thereby obtains an immediate swing elevation and experiences an initial speed which is higher and faster than starting to swing from the ground. But, even in these systems the initial height above the ground which the rider experiences would seldom be more than about one to four meters.

Japanese patent no. 36-2475 dated Apr. 1, 1961, to Nogima describes a chair-type swing having a cradle which is pulled to a launch position by a sliding car on rails. However, this device is clumsy in operation and its construction restricts the release height of the chair. Further, the cradle does not spin during operation.

In some swing systems, and especially those designed for small children, and in some amusement rides, bungee jumping equipment, parachute equipment, hang gliding systems, and the like, mechanisms for securing a rider to the equipment is provided. But, none of these systems provide a ride which initiates a rider module release at a height of more than ten meters above the ground. The prior art swing sets have not been large enough, strong enough or high enough to justify the use of a module for riders. Furthermore, prior art swing technology has not been known to operate at heights which allow a rider to reach a height which is greater than about seven to ten meters above the ground, or, other than in a trapeze system, to swing from a "launch" structure towards a "support" structure. It is noted that in trapeze systems, the swings are intentionally "high above the center ring", and never approach the ground.

Kitchen '906 and Kitchen '223 disclose an amusement ride and swing-type amusement ride which comprise a support structure, a support line, and a launch structure. However, Kitchen '906 support the rider(s) in a harness or an equivalent which causes the rider(s) to operate in the prone position. Some persons cannot handle this prone position for a variety of reasons including fear and physical incapacity. Older or physically challenged riders sometimes cannot handle strapping into a harness in a prone position.

U.S. Pat. No. 5,931,740 (1999) to Kitchen discloses a giant swing ride having a rotating rider module. Rider loading for this ride is preferably done at ground level.

In Kitchen '223 a multi-rider embodiment referred to as the Skysaucer™ can accommodate up to 120 riders in a saucer suspended from a support structure. However, the Kitchen '223 riders are seated in a plurality of rows, and the Skysaucer™ does not rotate about the axis of the support lines.

One giant swing ride is known which loads the riders high atop the launch tower. U.S. Pat. No. 1,220,332 (1917) to Happel discloses a launch tower with stairs for the riders to ascend. A two-person chair is hoisted to the top of the launch tower and locked in place. The riders load into the chair. The operator pulls a release handle to launch the chair. However, a dangerous situation is created high above the ground by exposing the riders to falling straight out the front of the chair during the load operation.

The present invention offers the added thrill of mounting the ride high up in the air (like a bungee jump). Simultaneously the present invention creates a 360° safety partition around the rider during his load procedure into the rider module.

SUMMARY OF THE INVENTION

The main aspect of the present invention is to provide a rider the thrill of loading onto a support line with a harness or a rider module high in the air, and then be launched into a giant swing trajectory.

Another aspect of the present invention is to provide a 360° safety partition such as a guardrail around the rider during his load procedure.

It is, therefore, an aspect of the present invention to provide a rider of the subject amusement ride with a sensation of "body flight".

Another aspect of the present invention is to provide the thrills and excitement of bungee jumping, but without the dangers related to the use of rubber or elastic cords, without the possibility of failing to make harness connections to the support line, and without subjecting the body of the rider to the type of stress borne by a bungee jumper, and without the natural fear of a "free fall" plunge associated with bungee jumping.

Yet another aspect of the present invention is to provide an amusement ride which can be enjoyed by a single rider secured in a single rider module, or by a plurality of riders who may enjoy the thrill of riding together while secured in a multi-rider module.

Yet another aspect of the present invention is to provide an amusement ride which can include a plurality of rider modules to afford simultaneous rides to numerous riders.

Another important aspect of the present invention is to provide a body flight experience for the physically-challenged rider.

Yet a further aspect of the present invention is to furnish an amusement ride which provides smooth, fast acceleration, excitement and thrills, while being a fail safe ride, without the anxiety and trauma related to finding the nerve to jump from an elevated platform in a "free fall" plunge, such as that which is associated with bungee jumping and sky diving.

Another aspect of the present invention is to provide an amusement ride in which the rider swings back and forth in a pendulum-like motion about a dozen times or more before terminating the ride.

Another aspect of the multi-rider embodiment is to provide a means for safely allowing many riders to enjoy the ride together, thus providing a more secure feeling to each rider than the single rider embodiment.

Another aspect of the multi-rider embodiment is to provide a faster and more elevated ride than the single rider embodiment.

Another aspect of the multi-rider embodiment is to allow more riders to be serviced in a given time than the single rider embodiment, thereby providing greater revenue to the operator.

Other aspects of this invention will appear from the following description and appended claims, reference being had to the accompanying drawings forming a part of this specification wherein like reference characters designate corresponding parts in the several views.

The present invention provides a module-type amusement ride for loading one or more riders in a rider module atop a launch tower and launch from a position high aloft from a height of ten meters or more. The rider module is released to swing in a curved trajectory for thrill and excitement, but with little or no stress placed on the body of the rider(s). The amusement ride includes a support structure extending upwardly at least eleven meters above the ground (and as much as several hundred meters or more). The support structure may be a static tower, a static derrick, a static arch, a bridge, other static man-made structures, a crane, naturally occurring geological formations, and the like.

One end of a rider module support line is secured to the upper portion of the support structure at a point which is at least eleven meters from the ground, while the second end of the rider module support line is secured to a rider module securing attachment, to which a rider module can be secured during the ride. The rider module may comprise a seat or a sling which puts a rider in a seated position. A plurality of rider modules may be attached to a support structure in this manner. In preferred embodiments, one end of a second line, which is used as a stabilization line, is also secured to the upper portion of the support structure, while the second end of the stabilization line is also secured to the attachment which secures the rider module during the ride.

The rider module may comprise a chair assembly, a rotating outward facing chair module or a harness or a sling. The chair assembly comprises a plurality of chairs in a frame with rider restraints and a retaining bar similar to a ski-lift chair. The harness assembly is as described in U.S. Pat. No. 5,527,223 to Kitchen, FIGS. 6 and 7 (column 9, lines 37 to column 10, line 13 and column 11, lines 14 through 33), incorporated herein by reference. The sling is related to the harness but contains the non-obvious improvement of supporting the rider in a seated position. This is accomplished by attaching the sling to the stabilization line and support line at a point center-front on the rider. Each rider module embodiment may be interchanged with each of the others for the purposes of ride operation.

Disposed near the support structure is an upright launch structure having an upper portion which is spaced from the upper portion of the support structure. The launch structure may also be a static tower, a static derrick, a static arch, a bridge, other static man-made structures, a crane, naturally occurring geological formations, man made geological formations, and the like, which have an upper portion which has a height which reaches or exceeds at least eleven meters from the ground (and as much as several hundred meters or more). A plurality of launch towers may be used to accommodate the embodiment having a plurality of rider modules. Further, the launch tower may be attached to the top of the support structure to reduce the size of the footprint of the ride.

The upper portion of the launch structure carries a launch line which has a free end which is capable of being lowered and of being raised to a height which reaches or exceeds at least ten meters above the ground. In the plurality of rider modules embodiment, each rider module has its own launch line. One end of the launch line is designed to be releasably attached to the swivel on the rider module. As detailed below, the launch line is capable of raising a rider module which is releasably secured to an attachment to a height of at least eleven meters above the ground. The launch line is attached to the release device, preferably a quick release device.

In operation, the riders walk or take an elevator to the top of the launch tower. The ride launch tower crew places each rider in the rider module or harness or sling each of which is supported by the support line. The crew next releases the launch line from the rider module, and launches the rider by various means. After the ride operators then re-connect the launch line to retract the rider module towards the launch structure at a controlled speed. This causes the rider module to be raised towards the launch structure. If the rider module is properly connected to the support and/or stabilization lines, then at this time the rider module will be raised aloft from the ground. The rider module will be suspended from the support structure by the support and/or stabilization lines and from the launch structure by the launch line. As a fail safe measure, if the rider module is not properly connected to the support and/or stabilization lines, then at this time, the rider module will be pulled laterally. It will not be immediately raised aloft from the ground, and the operation can be terminated. As the launch line continues to be retracted towards the launch structure at a controlled speed, the rider module without rider(s) is raised in a curved path further and further from the ground, towards the launch structure and away from the support structure.

The launch tower crew then secures the rider module for the load operation.

In preferred embodiments, the support line is made of an aircraft-quality stainless-steel cable with safety in mind. Most importantly, the ride does not depend on the use of rubber and elastic bungee cords. As used herein, the "ground" may be an actual ground surface, or a man made surface such as pavement, tarmac, or a concrete pad and the like. The height of the structures or of the rider module from the ground may be measured with respect to the actual "ground", or to a depression below the structures, such as a river bed, ravine, valley, or the like. As used herein, the portion of the support structure to which the support line is attached, and the portion of the launch structure from which the launch line is attached will always be considered to be the "upper portion" of the structure.

In the preferred mode of operation, the rider module may be lifted directly to the top of the launch structure, and the support line and stabilization line secured to the rider module or other attachment. Then, the crew may launch him or herself from the launch structure in the rider module. In such an operation, the support line and stabilization line will be raised to the top of the launch structure by the launch line. This mode of operation will allow the support and stabilization lines to have a substantial amount of slack, thus making the initial part of the ride vertical rather than curved. By proper calculation of height and elasticity, the use of bungee support and stabilization lines would add further vertical drop to the ride. An elevator may be used to carry the riders to the top of the launch structure.

Alternatively, two support lines, or just a single support line could be used. It is preferred to use at least as many stabilization lines as support lines since the stabilization lines function also as backup safety lines for the unlikely event of support line failure.

In yet another embodiment, a plurality of rider modules may be supported from a single support structure. Each rider module is then operated from its respective launch tower and a launch line.

These and other aspects of the present invention will become apparent to those skilled in the art from the following detailed description, showing the contemplated novel construction, combination, and elements as herein described, and more particularly defined by the appended claims, it, being understood that changes in the precise embodiments to the herein disclosed invention are meant to be included as coming within the scope of the claims, except insofar as they may be precluded by the prior art.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
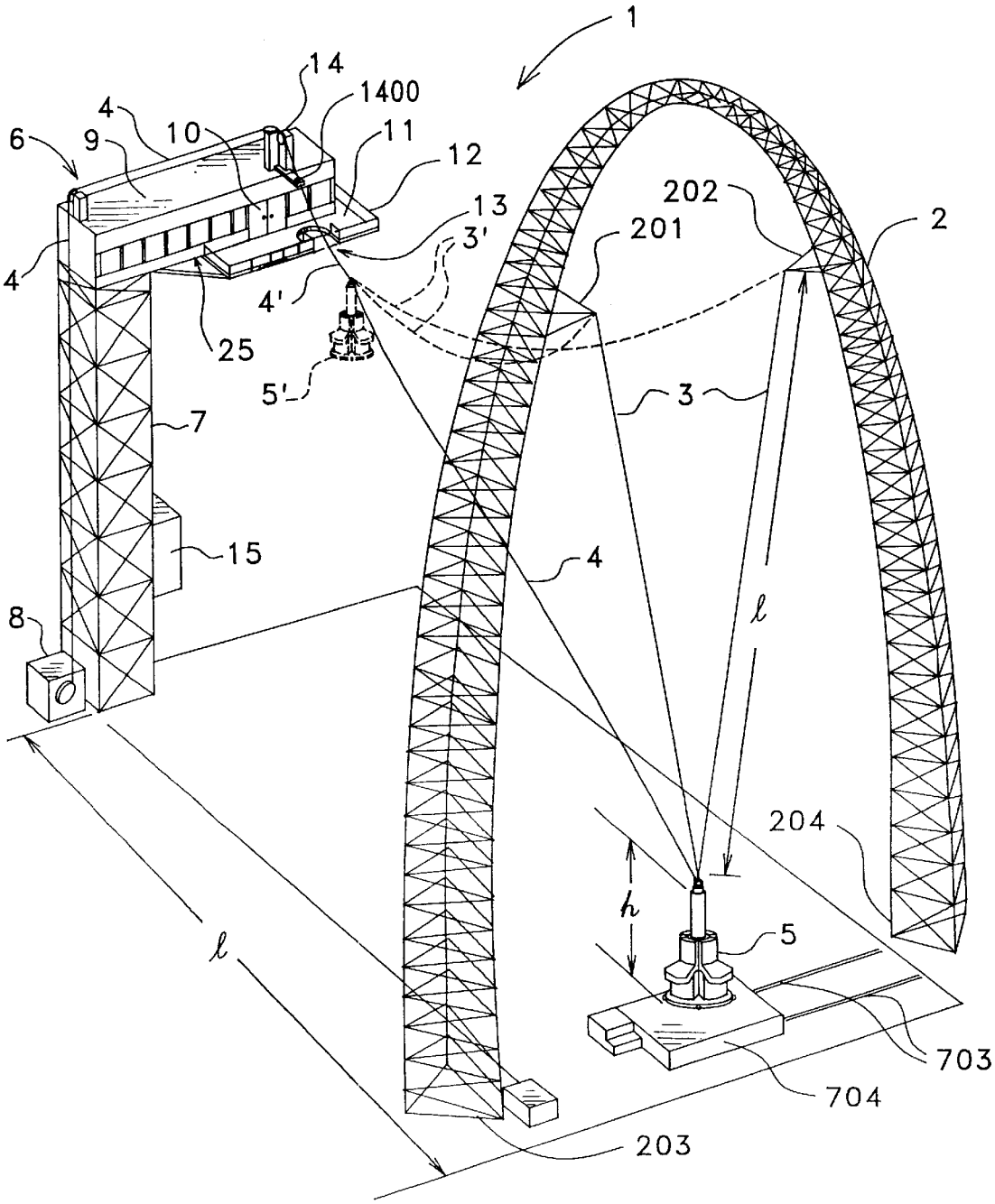
FIG. 1 is a top perspective view of the preferred embodiment giant swing ride.

Referring to FIG. 1 the giant swing 1 is comprised of a support tower 2. In the preferred embodiment the support tower 2 is an arch which supports two independent support anchors 201,202, wherein each anchor supports a support line 3. In a catastrophic failure either anchor and support line could support the rider module 5. The proper spacing of the legs 203,204 would prevent the rider module 5 from hitting the support tower 2 if one of the anchors 201,202 broke.

A launch line 4 is releasably attached to the rider module. A winch system includes a motorized reel assembly 8, a pulley assembly 14 and the launch line 4. The pulley assembly 14 must be located above the rider platform 11 a height greater than the height of the rider module in order to provide for a loading of the riders from the rider platform 11 to the rider module 5. The length of the line must be approximately the same as the distance 1 between the launch tower 6 and the support tower 2.

Figure 6:
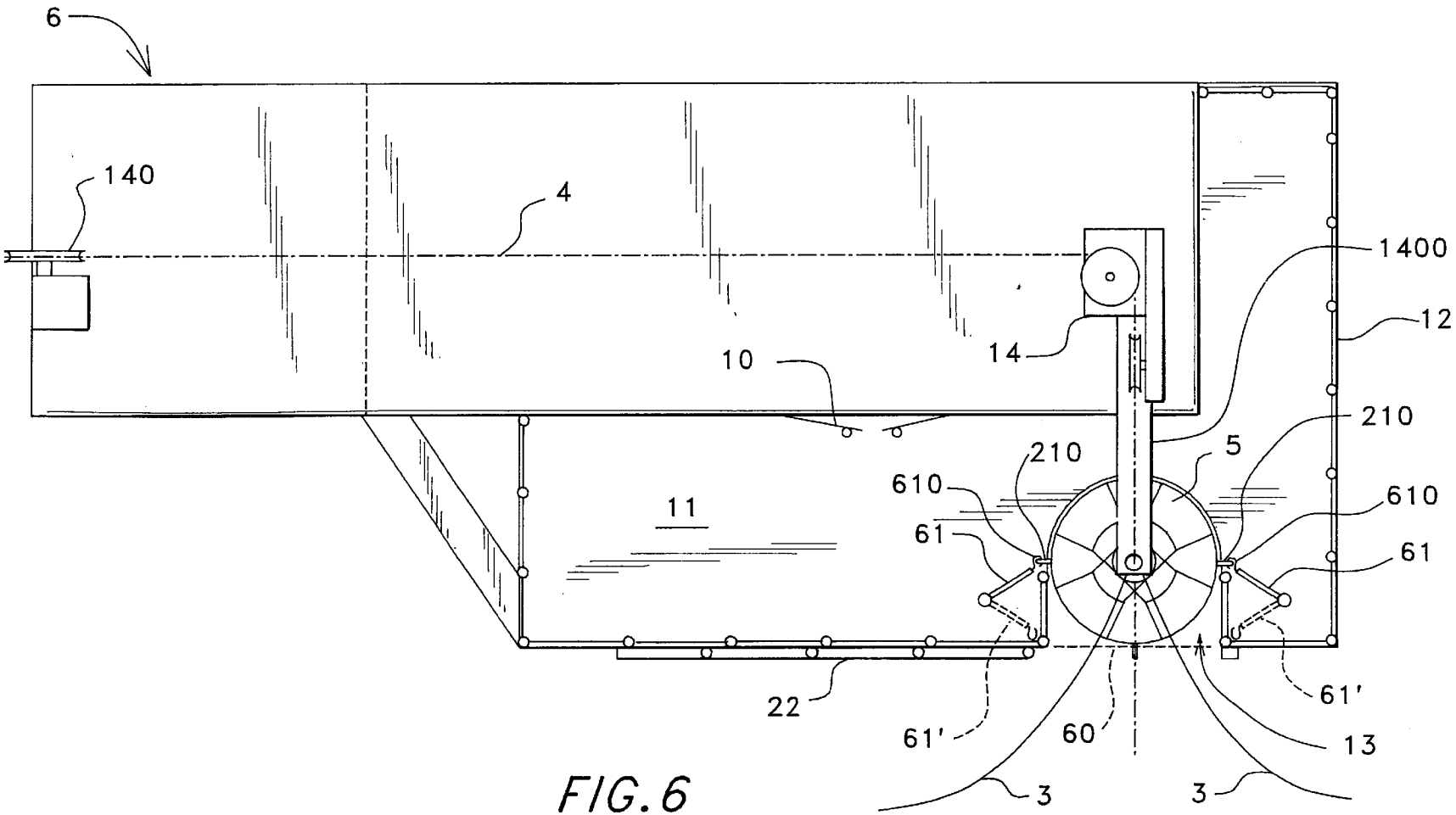
FIG. 6 is a top plan view of the structure shown in FIG. 5 with the rider module docked and the safety gate closed.

To prepare for a ride the motorized reel assembly 8 raises the rider module 5 to position 5', where the 3' and 4' numbers show like parts in the load mode, and the regular numerals show like parts in the unload mode. The rider module 5 is then raised into the recess 13 which is a receiving area for the rider module 5 in the rider platform 11. A guardrail 12 surrounds the docked rider module 5 360° by sliding the front gate 60 closed as best shown in FIG. 6.

The launch tower 6 is comprised of a vertical portion 7 with a horizontal portion 9 extending perpendicularly therefrom. A rider passageway 25 extends inside the horizontal portion 9 from the top of the vertical portion 7 to the doors 10. An elevator 15 may be used for transporting the riders to the top of the vertical portion 7, or stairs 16 may suffice as shown in FIG. 2.

Figure 8:
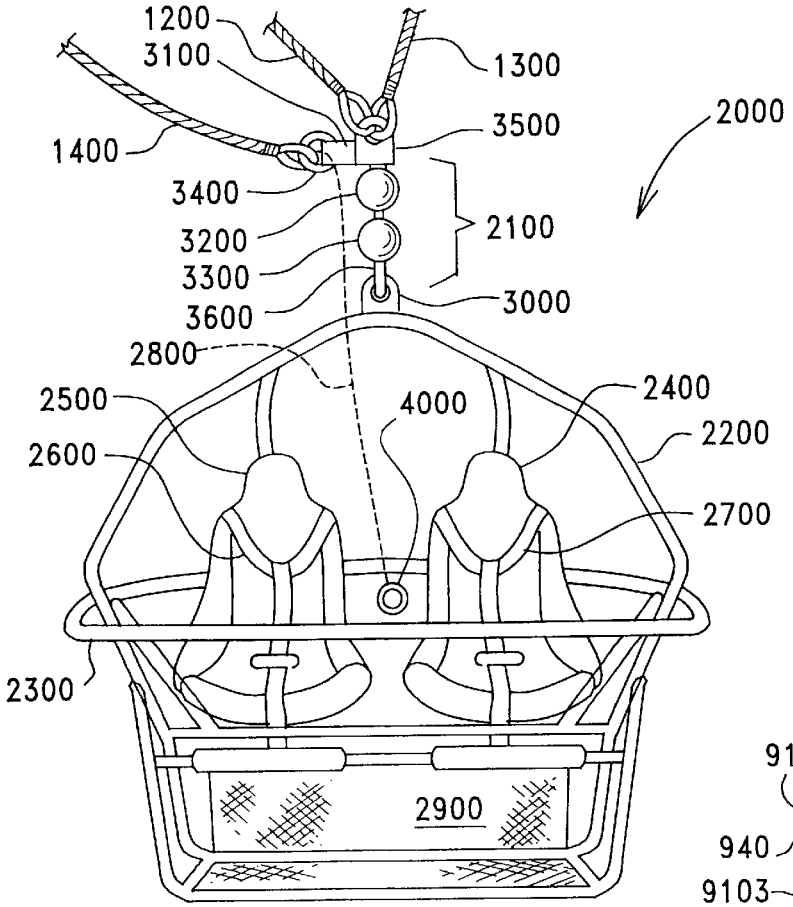
FIG. 8 is a front plan view of an alternate embodiment rider module.

After the riders are safely loaded, being completely surrounded with a guardrail 12 and/or the walls of the horizontal portion 9, the launch line 4 is manually removed from the rider module 5, and then the locking bar 61 shown in FIG. 8 is released, thus launching the rider module 5 in a giant swing trajectory.

Figure 2:
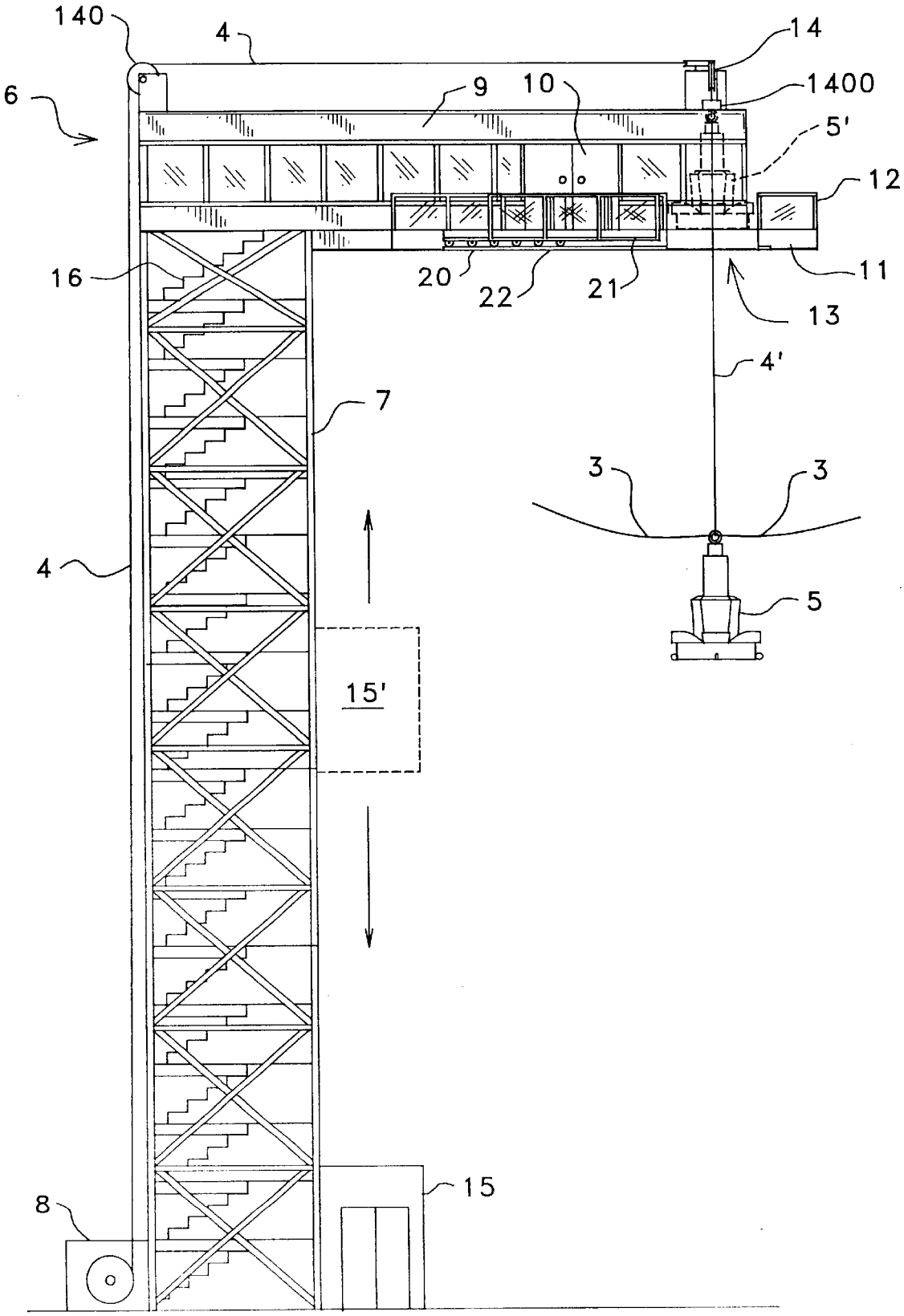
FIG. 2 is a front plan view of the launch tower shown in FIG. 1.

In FIG. 2 the optional elevator 15 is shown in motion as 15'. A corner pulley 140 cooperates with the pulley assembly 14 to control the launch line 4. The sliding safety gate 21 has a support housing 20 with a trolley rail 22 at the base for the safety gate 21 to roll on with its wheels (not,shown).

Figure 3:
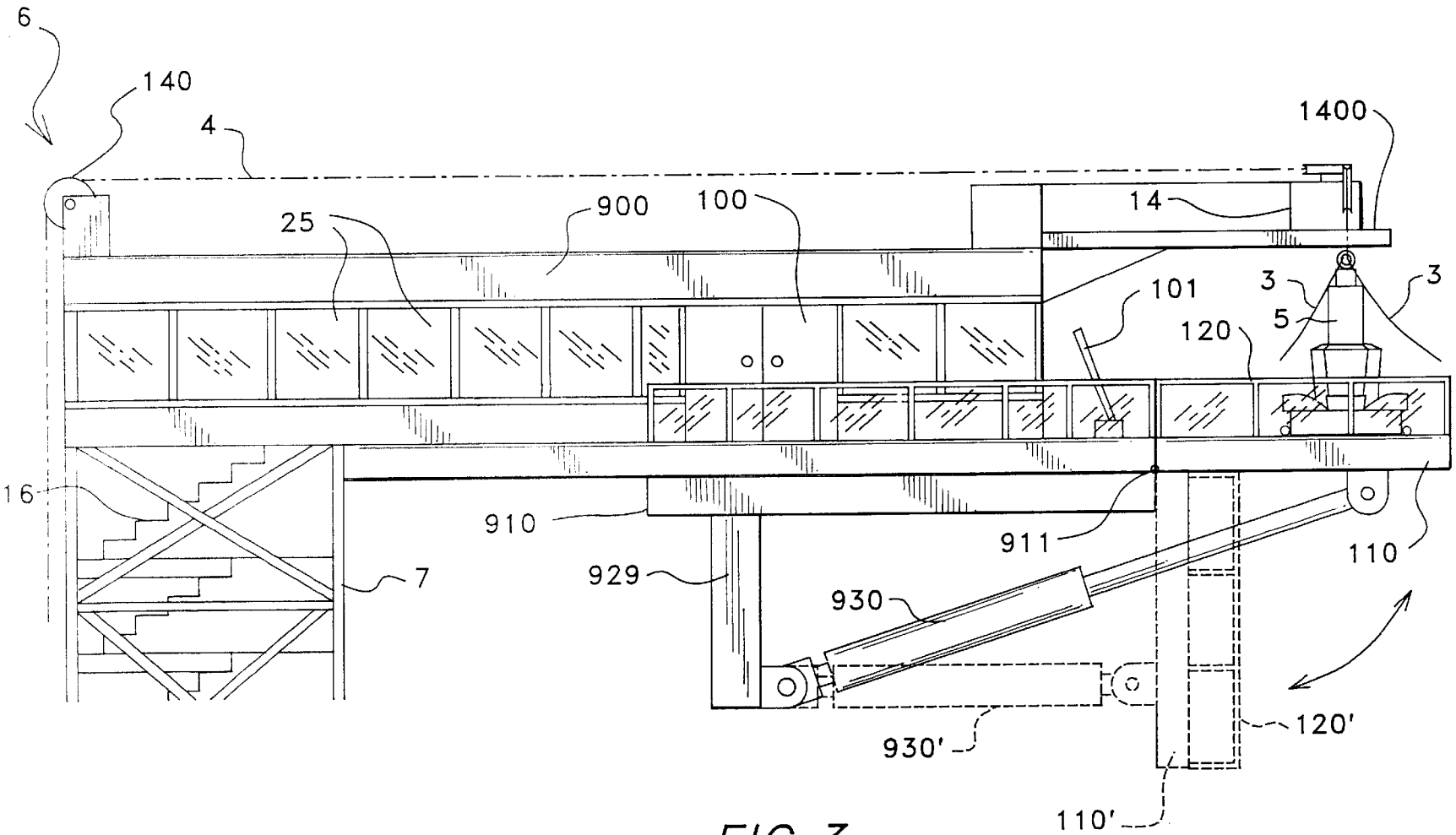
FIG. 3 is a front plan view of an alternate embodiment launch tower.

Referring next to FIG. 3 the vertical portion 900 is an alternate embodiment. The launch line and control components are the same. However, the rider platform 110 and guardrail 120 is hinged at 911. To launch the rider module 5, the launch crew operates release handle 101, thereby withdrawing the hydraulically powered post 930 back into the machinery housing 929. The rider platform 110 falls down to the position 110', thereby releasing the rider module 5 into the giant swing trajectory. A structural base 910 supports the hinge 911. The door 100 functions the same as door 10 to allow riders out only during a load procedure.

Figure 4:
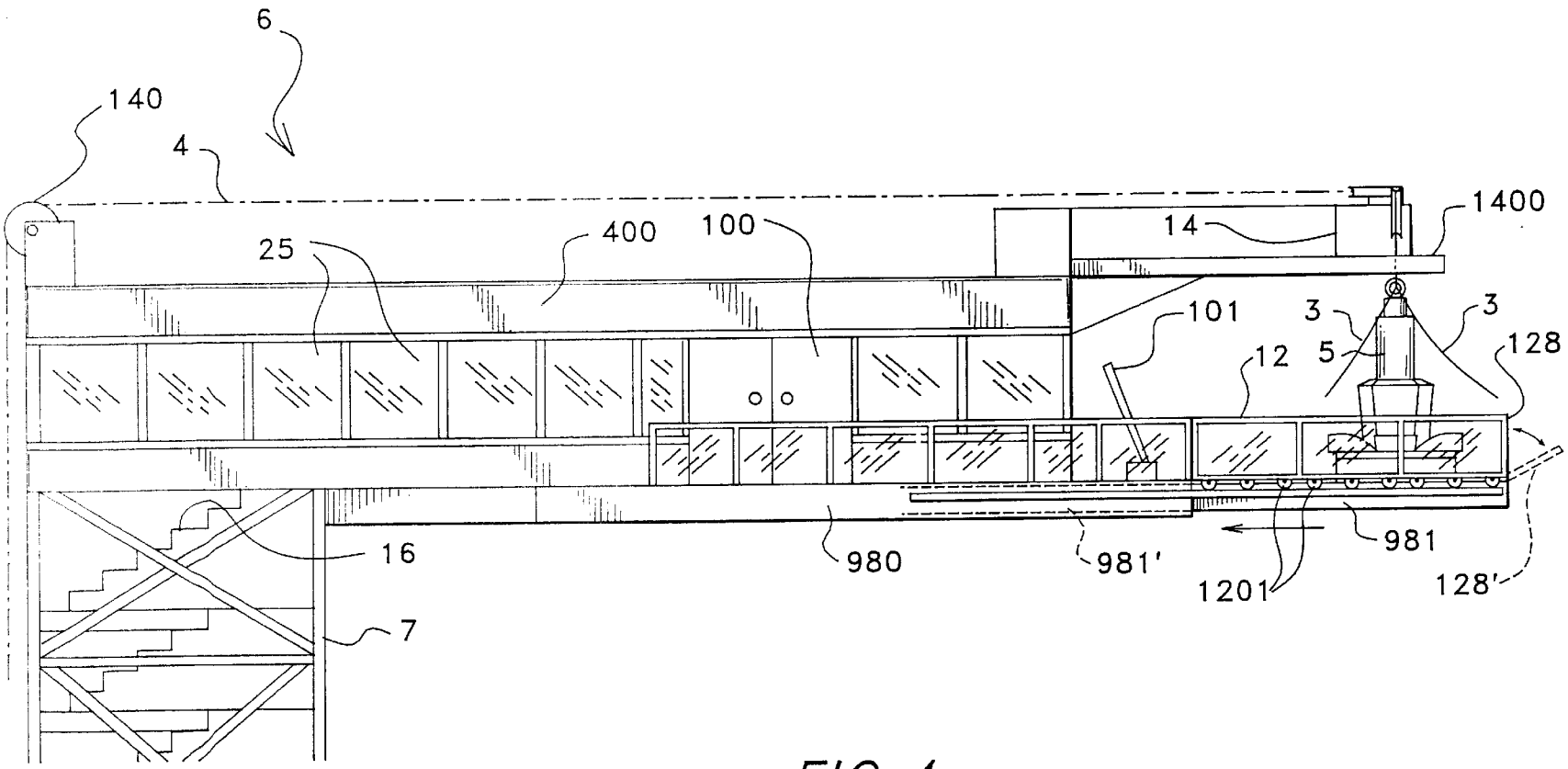
FIG. 4 is a front plan view of a second alternate embodiment launch tower.

Referring next to FIG. 4 another alternate embodiment vertical portion 400 is shown to have the same launch line 4 and associated winches. However, the rider platform 981 withdraws to position 981' for launch of the rider module 5. The portion 128 of the guardrail is folded down to position 128' by the launch crew before the launch is executed. For all the embodiments the launch line 4 must be released from the rider module before launch.

Figure 5:
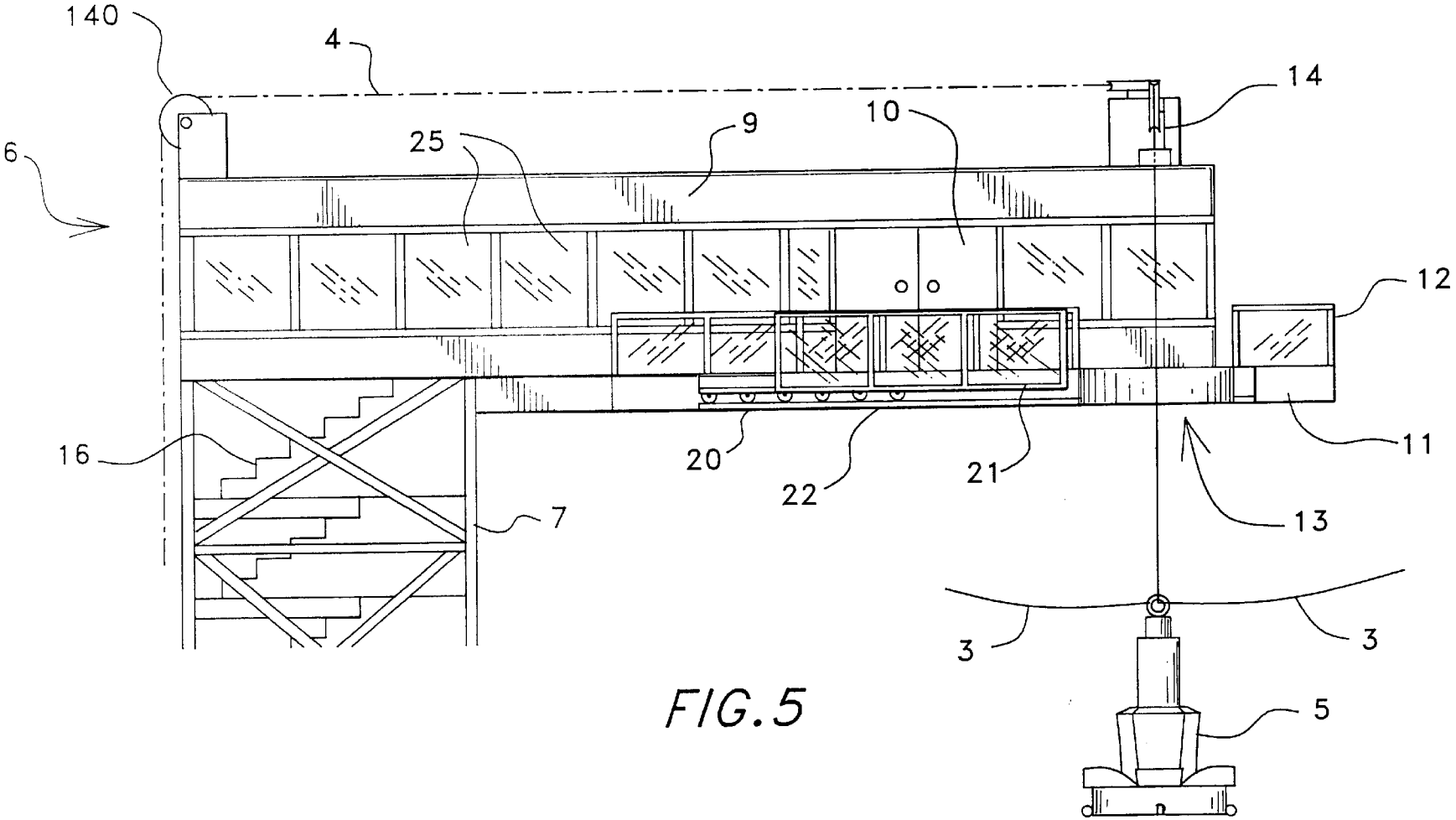
FIG. 5 is a front plan view of the preferred embodiment launch tower with the rider module almost docked, and the safety gate open.

Referring next to FIGS. 5,6 the preferred embodiment vertical portion 9 is shown. The guardrail 12 has a sliding gate 21 that rolls on a track 22 in a known manner. Rubber wheels on a recessed groove could be used or a raised track supporting metal wheels could be used to support the sliding gate 21. One simple mechanism to release the rider module into flight is shown with hooks 61 one on each of the rider module. The hooks 61 engage a ring 210, one on each side of the rider module 5. For launch the hooks 61 are rotated about 90° to position 61', thus releasing the rings 210. The tip 610 of hook 61 is curved to engage the ring 210.

Figure 7:
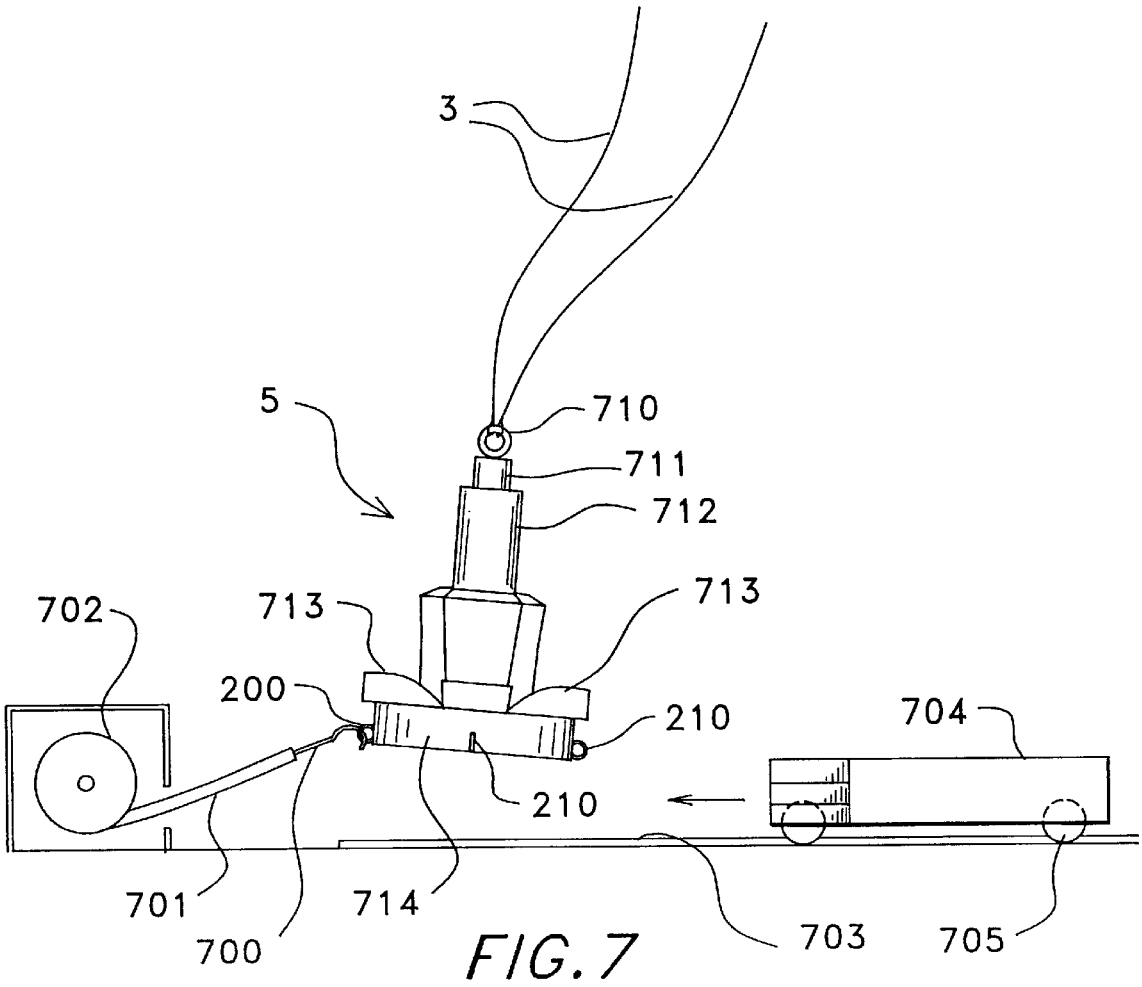
FIG. 7 is a front plan view of the preferred embodiment rider module during the disembark procedure.

Referring next to FIG. 7 a preferred unloading scheme is shown. The rider module 5 has a series of external rings 210 around its base 714. As the rider module 5 slows in its normal oscillatory swings, a ground crew attaches a hook 700 to one of the rings 210. The retractable line 701 is then reeled in by a known reel machinery 702 to stop the swinging. Next an unloading platform 704 is rolled under the rider module 5 via wheels 705 on track 703. The riders then unload.

An optional rider module 5 feature is to have a lynch pin 710 fastened to a vertical shaft 711. A ball bearing mounted outer cylinder 712 rotates around the vertical shaft 711. Four or more outboard facing seats 713 are mounted from the outer cylinder 712 as is the base 714.

Many inter changeable rider modules can be used with the above noted embodiments of rider platform.

FIG. 8 is a detail of the two-rider rider module 2000. Rider module 2000 is attached to attachment mechanism 2100 at eye 3000. Attachment mechanism 2100 is attached in turn to the lower end of stabilization line 1200 and the lower end of support line 1300. Attachment mechanism 2100 is also attached to launch line 1400 by release mechanism 3400. Release mechanism 3400 is attached to eye 3500 by eye 3100. Release mechanism 3400 is known in the art of sky diving as a three-ring release mechanism. Other known release mechanisms are released in a known manner by a release switch (not shown) located in the rider module or on the ground. Rider module 2000 comprises seats 2400 and 2500 secured to frame 2200. Each rider is restrained in each seat by seat belts 2600, 2700, respectively. Kick plate 2900 provides a firm surface to stand on while loading and unloading as well as providing protection for the riders' feet. Attachment mechanism 2100 also may comprise a swivel 3200, 3300, thereby enabling rider module 2000 to rotate through 360° on an axis roughly parallel to support line 1300 while swinging. Swivel 3200, 3300 rotatably attaches to eye 3500. The lower end of stabilization line 1200 and support line 1300 attach to eye 3500. Launch line 1400 is releasably attached to eye 3100 through release mechanism 3400. Release mechanism 3400 is operated by a launch tower crew by pulling on release ring 4000 which is attached to release line 2800. In operation, operator pulls on release ring 4000 which causes release mechanism to disconnect eye 3100 from launch line 1400.

Figure 9:
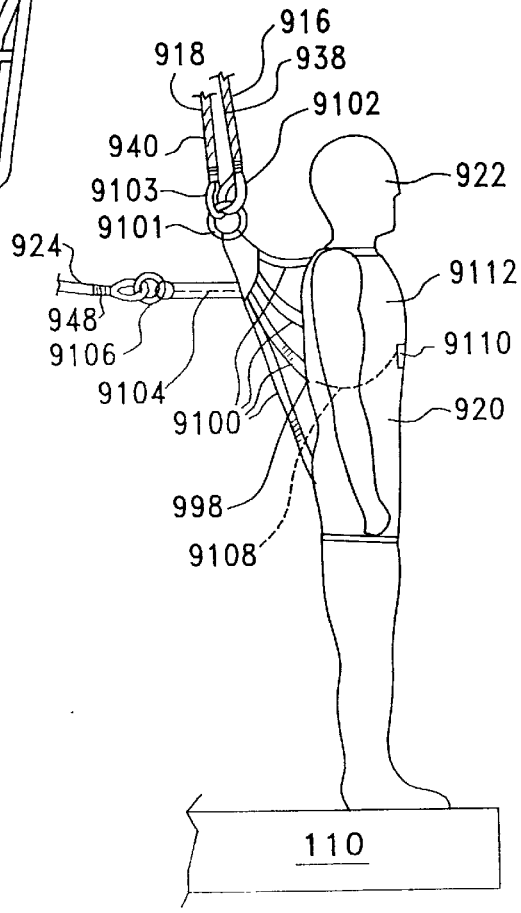
FIG. 9 is a left side plan view of a harness type alternate embodiment rider module.

Referring next to FIG. 9 it has been found that for smooth swinging and for fast acceleration of rider 922 after he is released from launch line 924 that support line 916 should be maintained taut during the swing so that it will normally carry the full weight of the rider 922. The stabilization line 918 is preferably connected to harness 920 with a slight amount of slack so that it does not cause deflection or deviation of rider 922 as support line 916 moves in a curved trajectory swinging the rider 922 back and forth under the support structure 912. The slack in a fixed length of stabilization line 918 can be adjusted by raising and lowering support and stabilization line mechanism 932, for example by using adjustment line 986. Adjustable line 986 has a first end 988 and a second end 990. The first end 988 of adjustment line 986 is attached to a pulley 992 which is shown mounted on top of the support structure 912. The second end 990 of adjustment lime 986 is attached to the stabilization line mounting plate 974. Disposed along the length of the adjustment line 986 us a line tension adjustment mechanism, such as turnbuckle 994. By adjusting the turnbuckle 994 on the adjustment line 986, stabilization line mounting plate 974 at the apex of support and stabilization line mechanism 932 which is pivotally mounted on support structure 912 is raised or lowered. This causes stabilization line 918 to be raised or lowered without the necessity of physically altering the length of line 918, and without raising or lowering support line 916. As mentioned above, stabilization line 918 also acts as a back up safety line and prevents torque or yaw of rider 922 from occurring during flight. In an alternate embodiment (not shown), support line 916 and stabilization line 918 are the same lengths and undergo the same forces.

In FIG. 9 a side view of male rider 922 is shown with the body harness 920 received and secured on his upper body. In this preferred embodiment, rider 922 is shown standing on top of a moveable rider platform 110 of FIG. 3. At this location, the lower second ends 938 and 940 of lines 916 and 918, respectively, are suspended sideways and shown removeably coupled to support ring 9101 of harness 920 by clasps 9102 and 9103. After launch rider 922 rotates into a face down prone position due to the configuration of harness connection 920. The launch crew releases the release 9106 before the rider platform 110 is dropped.

Harness 920 includes a back portion 998 having a plurality of support straps 910 which are joined together around support ring 9101. The lower second ends 938 and 940 of support line 916 and stabilization line 918 are attached to support ring 9101 from which the rider 922 will be suspended during the ride. The back portion 998 also includes a launch strap 9104 to which a release 9106, such as the 3-ring parachute type which is illustrated, is attached. Such 3-ring canopy release devices were first designed in 1976, and are a standard quick release mechanism used in the parachute industry, and are popular in the sport parachute business because it provides a 200:1 mechanical advantage. While the 3-ring release 9106 is shown, it is clear that other types of quick releases can be used equally well, such as the older two-button and cable models made for the United States military by the Capewell Mfg. Co. of Hartlord, Conn., USA. Release 9106 is connected to a manual launch cord 9108 disposed along the side of one of the support straps 9100 and terminating at a launch activation handle 9110 which is shown to be located on a front portion 9112 of the harness 920. During the operation of the present invention, the lower 948 of launch line 924 is connected to release 9106. The rider 922, while moving upward, or when held aloft, can at will use his hand to pull activation handle 9110. When activation handle 9110 is pulled, this in turn releases quick release 9106 from the launch line 924, and allows rider 922 to begin the falling and swinging action of the ride from a height of ten meters or more from the ground.

Figure 10:
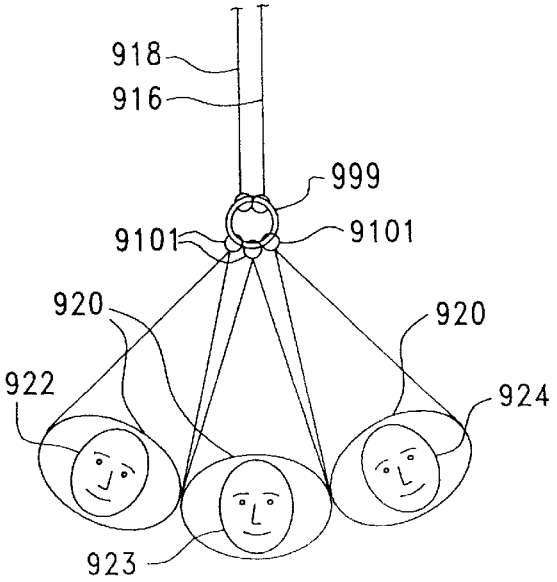
FIG. 10 is a front plan schematic view of a multi-rider harness type rider module.

In FIG. 10 rides 922,923,924 share a connecting ring 999. This harness type system can be tuned for more radical vertical drop and a parachute style mid air deceleration into a giant swing using known methods of cabling systems.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An amusement ride for loading and then launching at least one rider from a launch tower and releasing the rider to swing in a curved trajectory, the amusement ride comprising:

a support tower having a support line attached to a rider support mechanism for a rider to swing from the support tower;

a launch tower having a separation distance from the support tower of approximately one length of the support line;

said launch tower having a winch, a launch line, a loading platform and a launch pulley located above the loading platform;

said loading platform having a continuous safety partition to prevent a fall from the platform during a loading of the rider;

said loading platform having a release mechanism to launch the rider support mechanism to swing in the curved trajectory.

2. The amusement ride of claim 1, wherein the rider support mechanism is a harness and the release mechanism is a launch line release device.

3. The amusement ride of claim 1, wherein the launch tower further comprises a vertical portion and a horizontal portion mounted on the vertical portion, said horizontal portion having a rider passageway and an opening from the rider passageway to the loading platform.

4. The amusement ride of claim 3, wherein the support mechanism is a harness and the release mechanism is a launch line release device, and the continuous safety rail has an opening gate to allow the rider to launch theretrough.

5. The amusement ride of claim 3, wherein the support mechanism is a multi-rider carriage and the release mechanism is a launch line release device, and the continuous safety rail has an opening gate to allow the multi-rider carriage to launch theretrough.

6. The amusement ride of claim 5, wherein the multi-rider carriage further comprises a vertical shaft supporting a rotating platform therefrom, said rotating platform having a plurality of rider seats.

7. The amusement ride of claim 3, wherein the support mechanism is a multi-rider carriage and the release mechanism is a hinged segment on the loading platform which releases the multi-rider carriage to swing after the launch line is detached from the multi-rider carriage.

8. The amusement ride of claim 3, wherein the support mechanism is a multi-rider carriage and the release mechanism is a retractable segment on the loading platform which releases the multi-rider carriage to swing after the launch line is detached from the multi-rider carriage.

9. The amusement ride of claim 1 further comprising an unloading platform having wheels to move it from a passive position to an active unloading position.

10. The amusement ride of claim 1 further comprising a damping mechanism having a reel with a drag line to connect to the rider at the end of the ride to stop the rider from swinging.

11. The amusement ride of claim 1, wherein the loading platform further comprises a bungee jump apparatus.

12. An amusement ride for loading and then launching at least one rider from a launch tower and releasing the rider to swing in a curved trajectory, the amusement ride comprising:

a support tower having a support line with length (l) attached to a multi-rider conveyance;

a launch tower having a separation distance approximately equal to 1 from the support tower;

said launch tower having a vertical portion and a horizontal portion mounted atop the vertical portion, and having a launch line to lift the multi-rider conveyance;

said horizontal portion having a rider passageway from the vertical portion to opening;

a rider loading dock extending from the horizontal portion and accessible via the opening;

said rider loading dock having a safety partition to prevent falling and having a receiving area for a multi-rider conveyance;

wherein a rider goes up the vertical portion of the launch tower, moves down the rider passageway, exits the opening onto the rider loading dock, loads onto the multi-rider conveyance; and wherein the multi-rider conveyance has a release assembly to swing in the curved trajectory.

13. The amusement ride of claim 12, wherein the safety partition further comprises a guard rail.

14. The amusement ride of claim 12, wherein the receiving area further comprises a recess on the rider loading dock, and the release assembly further comprises a release bar releasably connecting the multi-rider conveyance to the launch tower, and a release mechanism from the launch line to the multi-rider conveyance.

15. An amusement ride comprising:

an elevated rider load and launch station;

a conveyance;

said launch station having a safety partition to prevent falling off in any direction when loading onto the conveyance;

a launch line, release assembly and a winch associated with the launch station to raise the conveyance and release the conveyance into a curved trajectory; and said conveyance having a support line connected to a support tower.

16. The amusement ride of claim 15, wherein the elevated rider load and launch station further comprises a vertical tower having a horizontal arm extending from a top of the vertical tower, said horizontal arm having a rider passageway connected to a skirt extending from the horizontal arm, said skirt having a receiving area for the conveyance, and said safety partition further comprising a guard rail having a gate to surround the conveyance during a load procedure.

17. The amusement ride of claim 15, wherein the rider load and launch station further comprises a dropping floor type launch mechanisms.

18. The amusement ride of claim 15, wherein the rider load and launch station further comprises a retractable floor type launch mechanism.

* * * * *